US008002318B2

(12) United States Patent
Saber

(10) Patent No.: US 8,002,318 B2
(45) Date of Patent: Aug. 23, 2011

(54) CONTAINER FOR PICKING UP AND TRANSPORTING WASTE, IN PARTICULAR DOG EXCREMENT

(76) Inventor: David Hamid Saber, Paris (FR)

( * ) Notice: Subject to any disclaimer, the term of this patent is extended or adjusted under 35 U.S.C. 154(b) by 524 days.

(21) Appl. No.: 12/049,707

(22) Filed: Mar. 17, 2008

(65) Prior Publication Data

US 2009/0179440 A1 Jul. 16, 2009

(30) Foreign Application Priority Data

Jan. 11, 2008 (FR) ..... 08 00157

(51) Int. Cl.
*E01H 1/12* (2006.01)
*E01H 1/00* (2006.01)
*A01K 29/00* (2006.01)

(52) U.S. Cl. ..... 294/1.3; 294/55; 15/257.1; 229/117.09

(58) Field of Classification Search ..... 294/1.3–1.5, 294/25, 55; 15/257.1, 257.6; 229/117, 117.01, 229/117.03, 117.09, 117.12
See application file for complete search history.

(56) References Cited

U.S. PATENT DOCUMENTS

| | | | | | |
|---|---|---|---|---|---|
| 3,373,917 | A | * | 3/1968 | Cox | 229/117.27 |
| 3,830,423 | A | | 8/1974 | Prescott | |
| 4,138,153 | A | * | 2/1979 | Brown | 294/1.4 |
| 4,205,869 | A | | 6/1980 | Mathis | |
| 4,252,356 | A | * | 2/1981 | Tokuzumi | 294/1.3 |
| 4,272,116 | A | * | 6/1981 | Tufte, Jr. | 294/1.3 |
| 4,974,893 | A | * | 12/1990 | Grahn | 294/1.3 |
| 5,033,780 | A | | 7/1991 | Wootten | |

FOREIGN PATENT DOCUMENTS

| | | | |
|---|---|---|---|
| EP | 1669301 | A | 6/2006 |
| FR | 2499513 | A | 8/1982 |
| FR | 2887229 | A1 | 12/2006 |

* cited by examiner

*Primary Examiner* — Paul T Chin
(74) *Attorney, Agent, or Firm* — Sughrue Mion, PLLC

(57) ABSTRACT

A container for picking up and transporting waste such as dog excrement comprises a bag extended by a flap suitable for closing and opening of the bag, the bag having a front wall and a rear wall, the flap extending the rear wall so as to be capable of occupying either an open position for picking up, in which it is folded against an outside face of the rear wall, or else a closed position for transport, in which it is folded against an outside face of the front wall. The invention relates to urban hygiene.

10 Claims, 5 Drawing Sheets

CONTAINER FOR PICKING UP AND TRANSPORTING WASTE, IN PARTICULAR DOG EXCREMENT

The invention relates to urban hygiene and provides a general structure for a container for picking up and transporting waste, in particular dog excrement.

BACKGROUND OF THE INVENTION

In this context, it is known to use a reversible glove that is used both for picking up and for transporting such waste. In order to pick up the waste, the user puts the glove onto one hand, then grasps the waste with the gloved hand, and then uses the other hand to turn the glove inside out. The waste is then held captive inside the glove and it is then necessary to close the outside end thereof before putting it into a waste bin.

In order to avoid the user having the disagreeable sensation of taking hold of the waste in the hand, other solutions have been devised involving a substantially rigid box or bag, as set out in patent document U.S. Pat. No. 5,222,777.

In that solution, provision is made for a substantially rectangular box made out of card and presenting an opening defined by a rectangular edge that is extended around its entire periphery by a skirt made of plastics material or of flexible fabric.

To use the bag, the user takes hold of the bottom of the box and turns the skirt inside out so that it surrounds the box. The user then presses the bottom edge of the opening against the ground and causes waste present on the ground to enter into the box. Once that has been done, the user turns the skirt back the right way out so that it extends the opening of the box, and then closes the end of the skirt. With that solution, the user does not have the disagreeable sensation of handling the waste, and dirt present on the ground cannot become deposited on the outside faces of the skirt or of the box because the skirt is turned inside out around the outside faces of the box while the waste is being picked up.

Nevertheless, that solution requires two kinds of material, namely a rigid or semirigid material of card type for the box, and a flexible material of flexible plastics or fabric type for the skirt.

Solutions similar to the above-described solutions are discloses in patent documents U.S. Pat. Nos. 4,836,594 A, 5,280,978 A, 5,282,660 A, and 5,584,519 A.

OBJECT OF THE INVENTION

The object of the invention is to propose a solution in the form of a container presenting production cost that is small compared with known solutions.

SUMMARY OF THE INVENTION

To this end, the invention provides a container for picking up and transporting dog excrement, the container comprising a bag extended by a flap suitable for closing and opening the bag, the bag having a front wall and a rear wall, the flap extending a top edge of the rear wall so as to be capable of occupying either an open position for picking up, in which the flap is folded against an outside face of the rear wall, or else a closed position for transport, in which the flap is folded against an outside face of the front wall.

With this arrangement, it is the inside face of the flap that comes into contact with the ground when the waste is being picked up. Dirt from the ground can at worst become deposited on the inside face of the flap, so that it cannot be present on the outside surface of the container once it has been reclosed.

Furthermore, when the flap is folded onto the outside face of the rear wall, it co-operates therewith to define a rigid leading edge that enables waste to be picked up with the same ease as if a scoop were being used.

The invention also provides a container as defined above, the flap and the bag are made out of the same material, such as cardstock.

The invention also provides a container as defined above, having first and second side walls each connecting a side edge of the front wall to a side edge of the rear wall, each side wall comprising a front panel and a rear panel defined by a central fold parallel to the side edges, these panels being capable of being folded against each other in order to move the front wall towards the rear wall in order to fold the bag flat.

With this arrangement, the bag can be folded up completely by folding its front wall against its rear wall, so that it takes up a generally plane shape making it easier to transport or to store.

The invention also provides a container as defined above, including at least one internal side reinforcement pivotable about an axis coinciding with a side edge of the front or rear wall so as to be foldable either against an inside face of one of the side walls so as to hold the bag deployed by moving the front and rear walls apart from each other, or else against an inside face of the front or rear wall so as to allow said walls to move towards each other in order to fold the bag flat.

By means of the internal side reinforcement, the bag can be kept completely deployed in stable manner, so as to avoid any risk of it folding up again in untimely manner.

The invention also provides a container as defined above, including a strap for deploying the bag, the strap having an end that passes through a side wall and that is fastened to a corresponding internal side reinforcement in such a manner as to enable the bag to be deployed by pulling on the strap to fold the side reinforcement against the side wall.

Once the container has been opened, its bag is deployed merely by exerting traction on the ends of the strap.

The invention also provides a container as defined above, including at least one catch or extra thickness projecting from the inside face of the front wall opposite from the front or rear wall having the edge that coincides with the axis about which the internal side reinforcement is capable of being pivoted, so as to lock the internal side reinforcement when it is folded against the side wall.

With this locking member, the bag takes up the shape of a rectangular box that is practically rigid. Its mouth or opening is then very wide, making it easier to put waste into the bag.

The invention also provides a container as defined above, comprising a front panel fastened to the outside face of the wall of the bag, said front panel having two flaps forming handles that are movable between a position in which they are folded against the front wall, and a utilization position in which they extend perpendicularly to said front wall.

By means of this front panel, the container is provided with two retractable handles enabling it to be grasped firmly so as to make it easier to collect waste.

The invention also provides a container as defined above, comprising a flap having a first portion extended by a second portion to close the bag either when it is folded flat, by folding the first portion of the flap onto the front wall, or else when it is deployed, by folding the second portion of the flap onto the front wall.

This extended flap enables the container to be folded either after previously folding the bag flat, or else while keeping the bag completely deployed.

The invention also provides a container as defined above, in which each side wall is provided with a deployer including at least one resilient return means continuously tending to urge the two panels forming each side wall into a position in which they are substantially coplanar.

With this deployer, the bag deploys completely in automatic manner as soon as its flap has been opened.

The invention also provides a container as defined above, in which each deployer comprises two flaps, each fitted to a respective one of the panels of the side wall equipped with the deployer, and in which each flap includes a hook or loop textile strip fastened to its outside face.

These textile strips enable the bag to be kept folded in a stable manner prior to closing the bag by moving its flap against the outside face of its front wall.

The invention also provides a container as defined above, in which each deployer includes a tab that is movable between a first position, in which it covers the hook or loop textile strips of the deployer, and a second position, in which it is folded against an outside face of the side wall to which the deployer is fitted, so as to uncover the hook or loop textile strips.

DETAILED DESCRIPTION OF THE INVENTION

Figure 1:
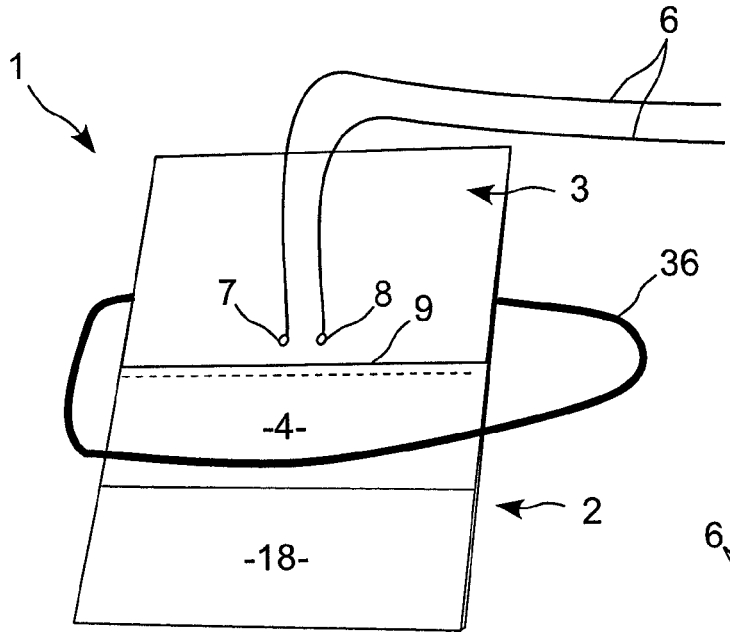
FIG. 1 is an overall view of a container constituting a first embodiment of the invention when it is closed with its bag folded flat.

The container 1 of the invention comprises a bag 2 forming the body of the container and a closure flap 3 extending the bag 2 and being secured thereto. The flap 3 is suitable for closing the bag 2 when placed against a front wall 4 thereof, as shown in FIG. 1.

The bag 2 and the flap 3 are both made of the same material such as cardstock, paper, or indeed plastics material. The assembly is advantageously leakproof, e.g. being made from card or paper that is either treated with wax or else provided with an additional internal lining of plastics material.

The flap 3 may be of rectangular outline, and it is secured to the bag 2 via one of the long sides of its outline.

The container 1 is provided with an "opening" strap 6 having both ends secured to the flap 3, via two eyelets 7 and 8 passing through the thickness of the flap 3 and being situated along the free margin 9 of the rectangular outline of the flap 3.

Figure 2:
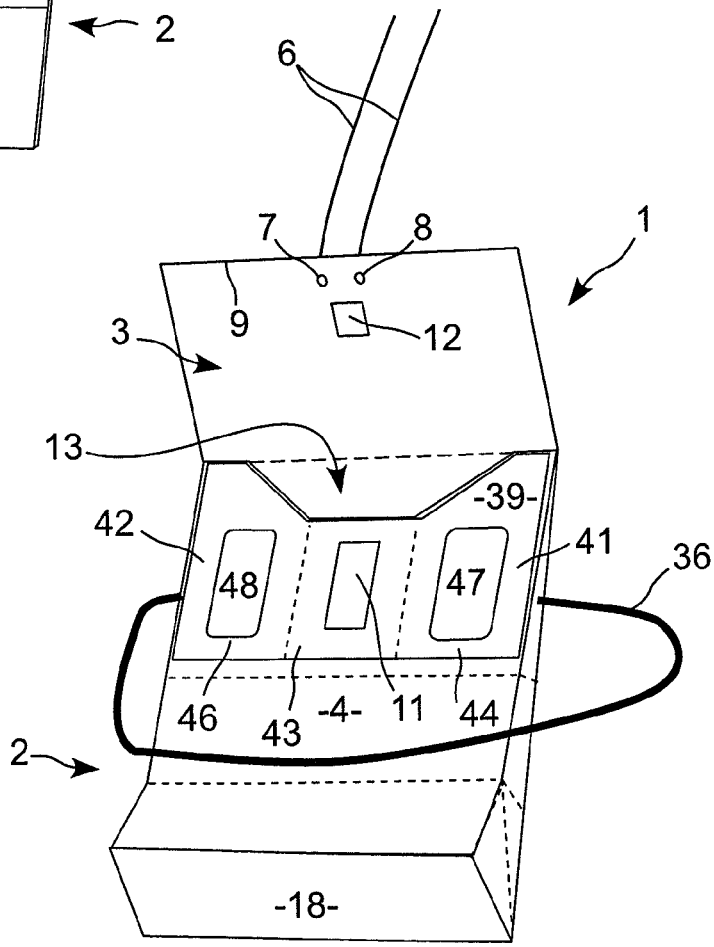
FIG. 2 is an overall view of the container of the first embodiment of the invention when partially open with its bag partially deployed.

As can be seen in FIG. 2, opening the container 1 consists in pulling on the opening strap 6 in a direction normal to the front wall 4 so as to separate the flap 3 therefrom, the flap 3 being held secured to said wall 4 by fastener means, e.g. of the type comprising hook and loop textile.

The fastener comprises a first strip 11 fastened to the front wall, and a second strip 12 fastened to the flap 3 in the vicinity of the eyelets 7 and 8, these two strips holding together on being pressed one against the other when the flap 3 is placed against the front wall 4.

Figure 3:
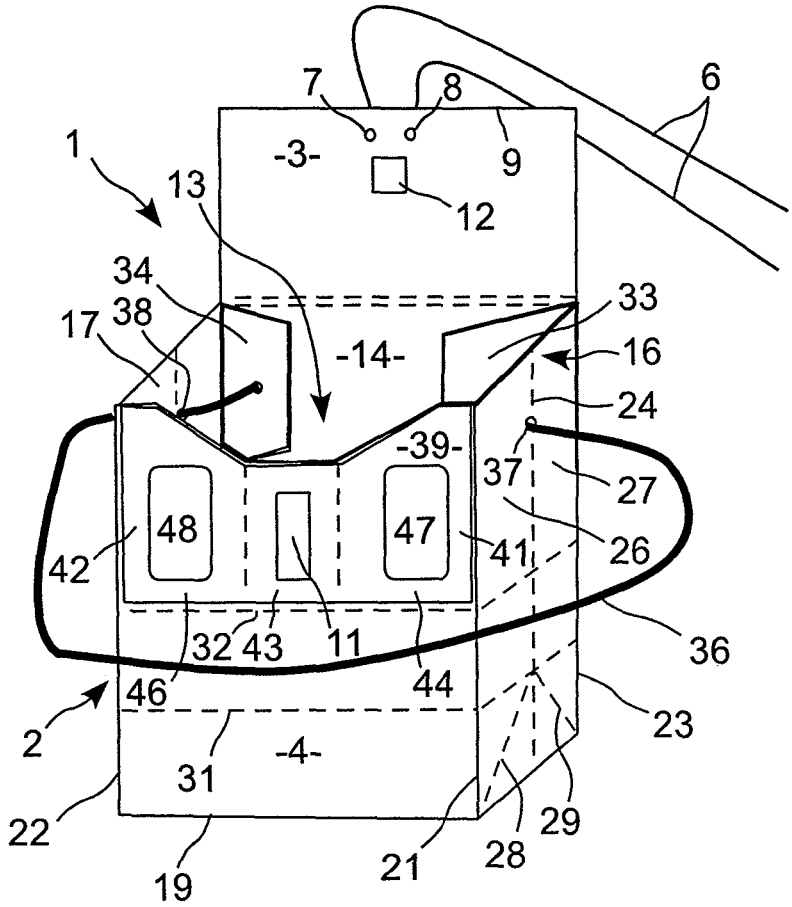
FIG. 3 is an overall view of the container of the first embodiment of the invention when it is open with its bag being deployed.

Opening the flap 3 gives access to the mouth or opening of the bag 2 which is referenced 13 in FIG. 2, this mouth then being capable of being enlarged by deploying the bag 2 completely, as shown in FIG. 3 where the bag 2 takes on the general form of a rectangular box.

The bag 2 has a front wall 4 of rectangular outline, a rear wall 14 of outline that is likewise rectangular, and first and second rectangular side walls 16 and 17, and a bottom 18 that is also rectangular.

The outline of the front wall 4 includes a "bottom" edge 19 that corresponds to a front edge of the bottom 18, and also first and second side edges referenced 21 and 22 that correspond respectively to a front edge of the first side wall 16 and to a front edge of the second side wall 17.

In analogous manner, the rear wall has a bottom edge corresponding to a rear edge of the bottom 18, and a first side edge 23 and a second side edge that correspond respectively to a rear edge of the first side wall 16 and to a rear edge of the second side wall 17.

A central fold or score line 24 parallel to the edges 21 and 23 subdivides the first side wall 16 into a front panel 26 and a rear panel 27, both of which are rectangular.

The first side wall 16 also includes two bottom oblique score lines 28 and 29 inclined at forty-five degrees relative to the edges 21 and 23, each extending from a bottom corner of the rectangular side wall to the central score line 24.

In analogous manner, the second side wall 17 has a fold parallel to the front and rear edges defining and subdividing it into two rectangular panels. It also has two bottom oblique score lines inclined at forty-five degrees relative to its edges.

The bag also has a "bottom" transverse peripheral score line and a "middle" peripheral score line given respective references 31 and 32. Each of these score lines passes in succession over the front wall, the first side wall, the rear wall, and then the second side wall. The bottom peripheral score line passes via the intersection between the oblique score lines and the central score lines in the side walls.

The generally rectangular shape of the bag 2 with its various score lines enables it to be deployed completely, as shown in FIG. 3, or else folded up into a flat shape, as shown in FIG. 1.

When the bag is completely folded, the front wall 4 comes against the rear wall 14, the first side wall 16 being folded so that its front panel 26 is folded onto its rear panel 27 so as to extend parallel to the front and rear walls 4 and 14 and between them. The second side wall is then likewise folded in half in analogous manner.

The bag may be folded completely flat, as shown in FIG. 1, where its bottom 18 is folded against the bottom portion of the front 4. It may also be folded flat in part only, as shown in FIG. 2, in which only the top portions of the front and rear walls 4 and 16 are flat one against the other, the bottom 18 then extending perpendicularly to said walls.

In order to make the bag 2 easier to deploy and to hold in the deployed position, the container 1 is provided with first and second internal side reinforcements referenced 33 and 34, and with a "deployment" strap referenced 36 and having its ends fastened to the reinforcements.

The first internal side reinforcement 33 is in the form of a flap of generally rectangular outline, and it can pivot about an axis that coincides with one of its edges, and in this example with the first side edge 23 of the rear wall. This reinforcement presents a length measured perpendicularly to the edge about which it is mounted to pivot that is substantially identical to the distance between the front wall 4 and the rear wall 14 when the bag 2 is completely deployed.

The first internal side reinforcement 33 is thus suitable for occupying either a "folded" position in which it extends along the rear wall 14, or else a "deployed" position in which it extends along an inside face of the first side wall 16, extending perpendicularly to the rear wall 14.

The second internal side reinforcement 34 has the same shape as the first, and it can likewise be folded either against the inside face of the rear wall 14, or else against the inside face of the second side all 17.

The deployment strap 36 has a first end passing through the first side wall via a hole 37 made therethrough, and said end is fastened to the first internal side reinforcement 33 in a central region thereof.

This strap has a second end that passes in like manner through the second side wall via a second hole 38 formed therein, and it is fastened to the second internal side reinforcement 34, in a central region thereof.

Each end of the strap 36 is fastened to a central region of a corresponding internal side reinforcement, by passing through the reinforcement via a hole provided for this purpose, and by means of a knot in the end of the strap that is situated on the side of the reinforcement that faces the rear wall 14 when folded thereagainst. The holes in the side reinforcements 33 and 34 can be seen in FIG. 5 where they are referenced respectively by 35 and 40.

With this arrangement, starting from a state in which the bag is folded completely, with its front wall 4 pressed against its rear wall 14, deployment of the bag consists merely in pulling on each of the ends of the deployment strap 36 in order to place the internal lateral reinforcements 33 and 34 in the deployed position, so that they hold the front wall 4 spaced apart from the rear wall 14.

Locking means are provided on the inside face of the front wall for locking the internal side reinforcement in position once the bag has been deployed completely.

The container of the invention is also provided with a front panel 39 fitted on and fastened to the top portion of the outside face of the front wall 4, and having first and second handles referenced 41 and 42, for holding the container 1 while picking up waste.

The front panel 39 has a rectangular central portion 43 whereby it is fastened to the front wall 4, e.g. by adhesive, together with a first flap 44 and a second flap 46, each extending one of the long edges of the rectangular outline of the central portion 43.

Each flap 44, 46 is provided with a corresponding opening 47, 48 for forming the handles or loops that enable the container 1 to be grasped. The flaps 44 and 46 are suitable for pivoting about respective first and second score lines referenced respectively 49 and 51 and coinciding with the edges defining the central portion 43.

Figure 4:
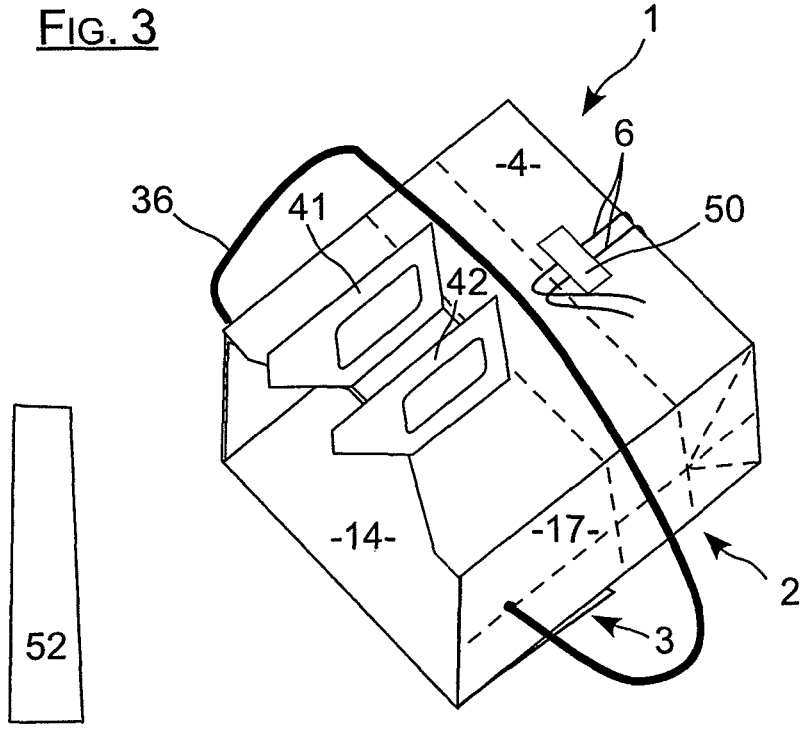
FIG. 4 is an overall view of the container of the first embodiment of the invention while it is in use for picking up waste (not shown)

Each flap 44 or 46 is movable between a position in which it is folded against the front wall 4, as shown in FIGS. 1 to 3, and a position perpendicular to said wall, as shown in FIG. 4.

The container of the invention is advantageously supplied in the form of a packet containing a plurality of containers folded flat and ready for use. The packet is presented in packaging such as a box or flexible wrapping.

In the packet, each container is folded flat with its flap 3 against the outside face of the rear wall 14 and held in position by the opening strap 6.

This strap 6 then surrounds the container 1 in part, going along the bottom 18 to hold the flap 3, and being fastened to an outside face of the container. It can be fastened by means of an adhesive strip such as that referenced 50 in FIG. 4.

The container may also be folded in half, about the middle transverse score line 32, so as to reduce its size.

Once the user has extracted the container from the pile, and where appropriate unfolded it, the user pulls on the ends of the deployment strap 36 to deploy the bag 2 completely, by positioning the internal side reinforcements perpendicularly to the wall 14.

Once this has been done, the user deploys the flaps 44 and 46, so that the container can then be grasped by the handles 41 and 42.

The user then presses the assembly against the ground, keeping it in position with the help of the handles 41 and 42, the inside face of the flap 3 then being pressed against the ground. The waste or excrement is then moved towards the inside of the bag by the user, e.g. by means of a pusher 52 that is advantageously of dimensions that enable it to be housed inside the bag 2.

After the waste has been picked up, the user replaces the pusher 52 inside the bag 2 together with the waste, and folds the flaps 44 and 46 back against the front wall 4. The user then folds the bag 2, at least in part, by pressing against the top portions of the side walls 16 and 17 so as to replace the side reinforcements 33 and 34 against the rear wall 14 in order to move the top portion of the front wall 4 against the top portion of the rear wall 14.

Once the bag has been folded, the flap 3 can be moved onto the top portion of the outside face of the front wall 4, so as to close the container 1 by fastening the flap 3 to said top portion by means of the fastener constituted by the hoop and loop textile strips 11 and 12.

Figure 5:
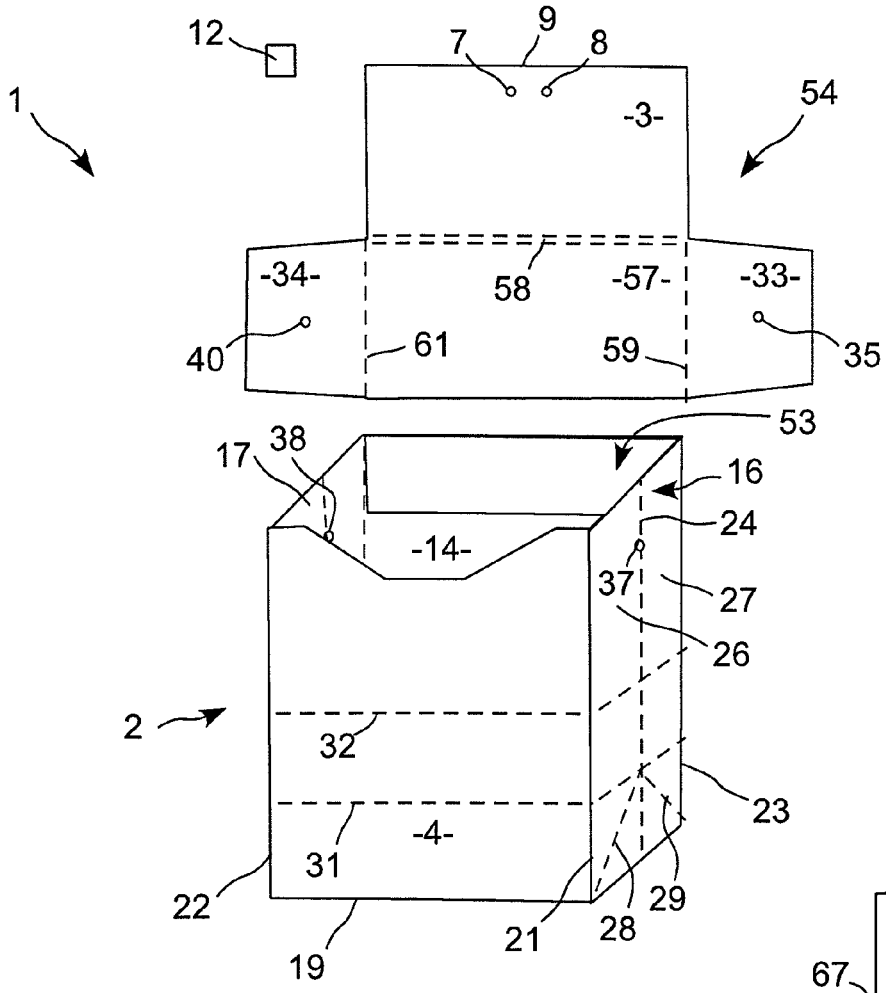
FIG. 5 is an exploded view showing separately the bag and first and second pieces fastened to the inside face of the rear wall of the bag to produce the package constituting the first embodiment of the invention.
Figure 7:
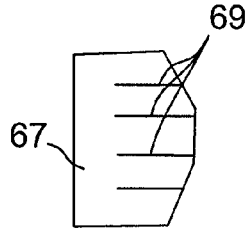
FIG. 7 is a view of locking means for the container in the first embodiment of the invention, the locking means being shown alone.
Figure 6:
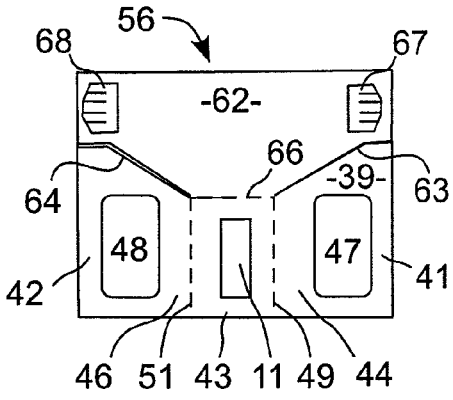
FIG. 6 shows a third piece fastened to the front wall of the bag, the part being shown on its own in a deployed state and in accordance with the first embodiment of the invention.

As shown in FIGS. 5 to 7, the container 1 of the invention is produced essentially from a bag 2 and three pieces cut out from cardstock and given respective references 53, 54, and 56.

The first piece 53 constitutes transverse reinforcement of rectangular shape, having a long side of length corresponding to the distance between the side walls 16 and 17. It is fastened, e.g. by adhesive, to the top portion of the inside face of the rear wall 14 of the bag 2, in such a manner that one of its long edges runs along the top edge of said rear wall 14.

The second piece 54 is cut out to a shape comprising a central rectangle 57 with long sides of length corresponding to the distance between the side walls 16 and 17. This central rectangle has one of its long sides, referenced 58, that is extended by the flap 3.

The short sides of this central rectangle, referenced 59 and 61, are extended respectively by the first internal side reinforcement 33 and by the second internal side reinforcement 34. Each side 58, 59, and 61 is embodied as a score line so that the portions extending beyond the central rectangular can pivot relative thereto.

This second piece is fitted to the inside face of the rear wall 14 with its central rectangular 57 being stuck thereagainst, above the transverse reinforcement 53, and in such a manner that the score line 58 runs along the top edge of the rear wall 14.

The third piece, referenced by 56, has an outline that is generally rectangular, comprising two distinct portions corresponding respectively to the front panel 39 and to a turn-back portion referenced 62.

The front panel 39 and the turn-back 62 are separated from each other by first and second cuts referenced 63 and 64. These cuts 63 and 64 start from two opposite sides of the rectangular outline and converge towards each other while their ends nevertheless remain spaced apart, being interconnected by a fold line referenced 66.

Each cut has a first portion that is perpendicular to the edge from which it starts, and that is extended by an oblique second portion terminating in the end of the cut.

As can be seen in FIG. 6, the central fold line 66 and the first portions of the cuts 63 and 64 are parallel and spaced apart from one another, the central portion 43 thus being smaller in height than the flaps 44 and 46 that extend it sideways.

The turn-back 62 is provided with first and second locking means for holding the side reinforcements in position once the bag has been deployed completely. These means are referenced 67 and 68 and they are formed by two cardstock pieces of small size, fastened to one of the faces of the turn-back 62, e.g. by adhesive.

These two locking means 67 and 68 constitute catch-forming extra thicknesses, and they are fastened to portions of the turn-back 62 that are each situated in the vicinity of a corner of the rectangle constituting the outline of the second piece 56.

As can be seen in FIG. 7, each locking means presents an outline that corresponds to the shape of the letter D, and it is provided with a plurality of parallel cuts referenced 69 that start from the curved portion of said outline and that extend perpendicularly to the rectilinear portion opposite from said curved portion.

As can be seen in the figures, the means 67 and 68 are positioned on the turn-back 62 in such a manner that their rectilinear edges face each other. The curved edges provided with the cutouts thus face away from each other, so as to form combs, each suitable for holding a free edge of an internal lateral reinforcement by mutual engagement.

Figure 8:
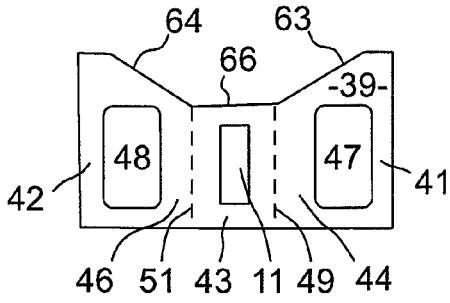
FIG. 8 shows a third piece for fastening to the front wall of the bag and shown on its own in a folded state for the first embodiment of the invention.

As shown in FIG. 8, putting the third piece 56 into place consists in folding it in half about the fold line 66, so that the turn-back 62 is placed against the front panel 39. The piece 56 then has a top edge constituted by the following in succession: the cut 63; the fold line 66; and the cut 64; thereby producing a notch-shape that is identical to the notch-shape of the top edge of the front wall 4.

The piece is then stuck to the front wall 4 in such a manner that the top edge of the piece 56 coincides with the top edge of the front wall 4, the front panel 39 being folded down onto the outside face of said wall, the turn-back 62 itself being folded down onto its inside face. The piece is fastened to the front wall 4, e.g. by adhesive.

In this situation, the catches 67 and 68 constitute extra thicknesses that project towards the rear wall 14 so that when the side reinforcements 33 and 34 are folded towards the side walls 16 and 17, their free edges come to press against these extra thicknesses and go beyond them once folded completely against the side walls.

In this situation, the curved edges of the catches 67 and 68 constitute abutments or stoppers opposing spontaneous return of the internal side reinforcements towards their position in which they are folded against the rear wall, so as to prevent the bag 2 from folding up in untimely manner.

In contrast, when the user desires to fold up the bag 2, by exerting pressure on the top portions of the side walls 16 and 17 urging them towards each other, the user enables the side reinforcements to go past the stoppers 67 and 68 so as to enable the bag 2 to be folded up flat.

In a second embodiment of the invention, the bag is provided with means that enable it to be deployed automatically as soon as its flap is detached from its front wall, and its flap is also provided with means for closing the bag without it being essential to fold up the bag.

This second embodiment is shown in FIGS. 9 to 14 and it has many elements in common with elements of the first embodiment.

Each element of the second embodiment is identified by a reference constituted by a number associated with the prime symbol, whereas each element of the first embodiment is identified by a reference constituted by a number on its own. Unless stated to the contrary, each element of the second embodiment that has the same number in its reference as a reference for an element of the first embodiment is identical to said element of the first embodiment.

Each of the elements 1 to 69 of the first embodiment has a corresponding element in the second embodiment, with the exception of the elements 8 and 33 to 38 which relate for the most part to the side reinforcements and to the deployment strap. The second embodiment also has additional elements, identified by references 71' to 102' that designate for the most part its deployers and to their corresponding components.

Thus, in this second embodiment, the container is referenced 1' and likewise comprises a bag 2' that is foldable and a flap 3' secured to the bag. The bag 2' also has a front wall 4' and a rear wall 14' capable of being moved towards each other in order to fold the bag flat.

As in the first embodiment, the front and rear walls of the bag 2' are connected together by a first side wall 16' and by a second side wall 17'.

The first side wall comprises a rectangular front panel 26' and a rectangular rear panel 27' joined together via a central fold or score line 24', thus enabling these panels to be folded against each other in order to fold the bag. In analogous manner, the second side wall 17' is likewise made up of two rectangular panels capable of folding against each other so as to enable the bag to be folded up by bringing its front wall 4' against its rear wall 14'.

The container 1' also has a front panel 39' fastened to the outside face of the front wall 4' of its bag 2', and it includes two handles 41' and 42' that can be either deployed perpendicularly to the front wall, or else folded down against said wall 4' so as to enable the container 1' to be closed.

Unlike the first embodiment, the container 1' does not have internal side reinforcements, nor does it have a deployment strap.

In this second embodiment, as soon as the closure flap is opened, deployment of the bag 2' is triggered automatically by means of two side deployers referenced 71' and 72', which deployers are fastened to the top portions of the outside faces of each of the side walls 16' and 17'.

Figure 10:
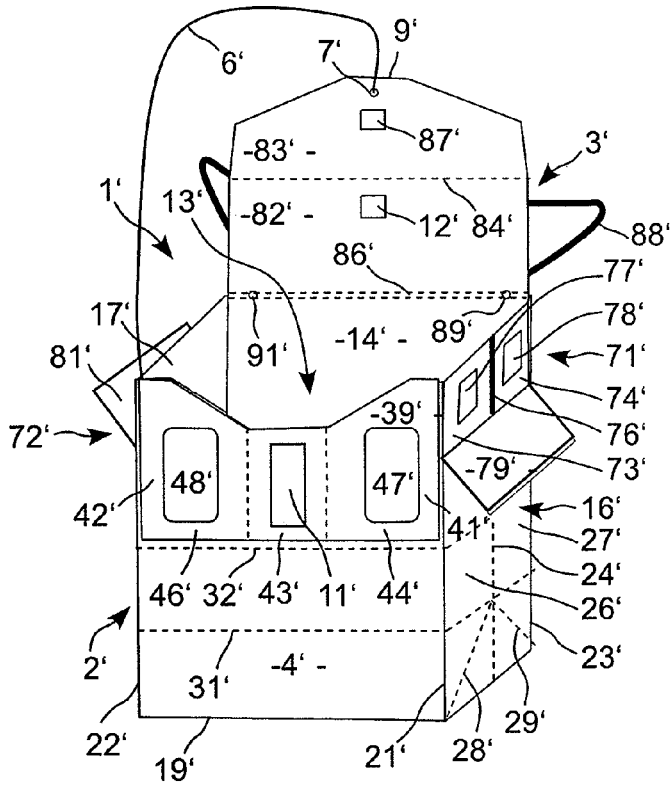
FIG. 10 is an overall view of the second embodiment of the container of the invention when open with its bag fully deployed.

As can be seen in FIG. 10, the side deployer 71' comprises a front flap 73' and a rear flap 74', which flaps are fastened respectively to the front panel 26' and to the rear panel 27' of the first side wall 16'. Each of these two flaps has a square outline and the flaps are connected to each other via a common edge 76' which runs along the central fold 24'.

The deployer 71' also has resilient return means tending continuously to urge these two contiguous flaps 73' and 74' into a common plane, it being possible to bring the front and rear panels one against the other against these return means.

The deployer is also provided with a hook and loop textile fastener comprising a first textile strip 77' fastened to the center of the outside face of the front flap 73', and a second textile strip 78' fastened to the center of the outside face of the rear flap 74'.

Thus, when the bag is to be folded up, the user can fold the front panel 26' against the rear panel 27' against the return means of the deployer 71' until the two fastener textile strips come into contact. This enables the front panel 26' and the rear panel 27' to be held together in a position in which they are folded one against the other, thus corresponding to the bag 2' being in a folded-up state in which its front wall 4' is against its rear wall 14'.

Figure 9:
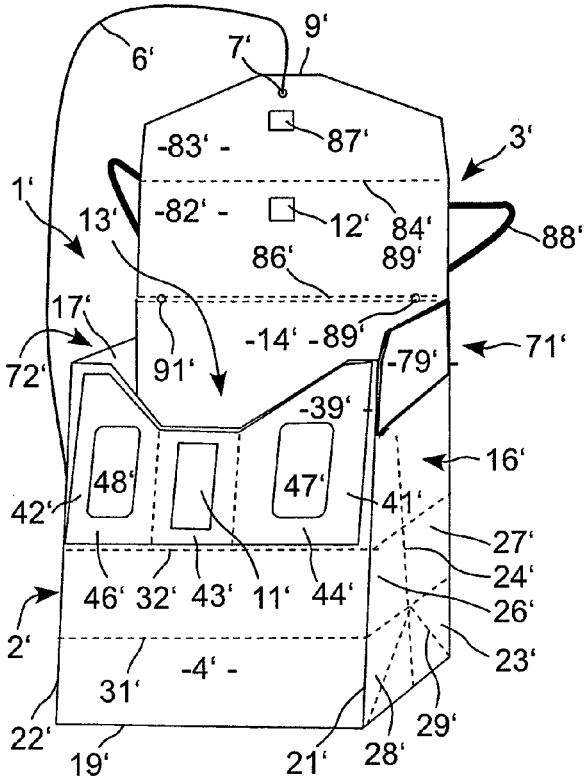
FIG. 9 is an overall view of a second embodiment of the bag of the invention when open while the bag is being deployed.
Figure 11:
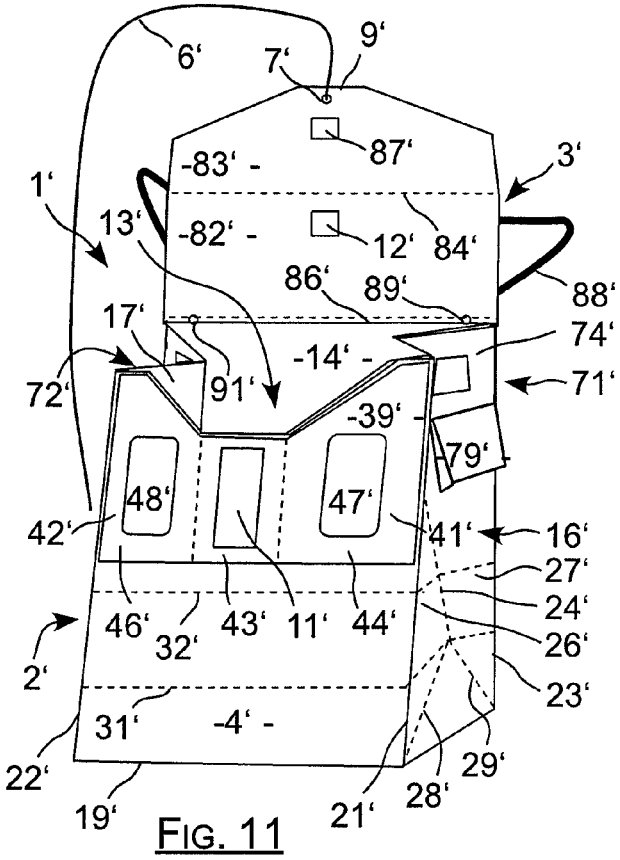
FIG. 11 is an overall view of the second embodiment of the container of the invention when open with its bag being folded up.

The deployer is also provided with a tab 79' suitable for being folded either against the outside faces of the two flaps 73' and 74' in order to mask the textile strips 77' and 78', as shown in FIG. 9, or else against the side wall so as to uncover these textile strips, thereby making them operational, as shown in FIGS. 10 and 11.

In analogous manner, the second deployer 72' likewise comprises two flaps that are fastened respectively to the front and rear panels of the second side wall and that are connected to each other by resilient return means. It also includes a fastener comprising a textile strip on each flap, together with a tab referenced 81' in FIG. 10.

As can be seen in the figures, the closure flap 3' is much longer than the closure flap 3 of the first embodiment, thus enabling it to close the mouth 13' of the bag 2', even when the bag has not been folded flat.

This flap 3' thus comprises a first portion 82' of dimensions that correspond to the outline of the mouth 13', i.e. that correspond substantially to the dimensions of the bottom of the bag 2', and a second portion extending the first and identified by reference 83'.

These two portions are connected together by a fold 84', the first portion being suitable for pivoting relative to the bag 2' about another fold, referenced 86' that coincides with the top edge of the rear face 14' along which it extends.

The first portion has a fastener textile strip 12' stuck to its inside face, and the second portion has complementary fastener textile strip, referenced 87' and stuck to its inside face.

In this embodiment also, the container is advantageously supplied in a packet containing a plurality of containers piled up flat, ready for use, and wrapped in a common wrapper. Each container then has its flap 3' folded against the rear wall 14' and held by the strap 6' that is fastened to the container by means of an adhesive strip, for example.

The container is then folded in half about the middle transverse score line 32' so as to reduce its size, and it is held folded in half by an elastic band. Each container in the packet is thus ready for use.

In this configuration, the two deployers 71' and 72' are folded so as to hold the two panels of each side wall 16' and 17' folded one against the other. The tabs 79' and 81' of these deployers are folded against the corresponding flap so as to make the hook and loop fasteners of each of the deployers inactive.

Once the user has extracted the container from the pile, and removed the elastic band, the container can be unfolded, thereby releasing the deployers 71' and 72', which unfold spontaneously, as shown in FIG. 9. This places the two panels of each side wall in line with the other, the bag 2' thus being completely deployed.

The user can then place the handles 41' and 42' perpendicularly to the front wall 4' in order to grasp the container for the purpose of collecting waste, in the same manner as with the first embodiment, i.e. in compliance with the diagrammatic illustration of FIG. 4. Once the waste has been collected, the container 1' can be closed without it being necessary to fold up the bag 2'.

Under such circumstances, the user folds the handles 41' and 42' against the front wall 4', then moves the closure flap 3' towards the front of the bag 2', which is then generally rectangular in shape, so as to press the second portion 83' of the flap 3' against the front panel 39'. Once this has been done, the second portion 83' of the flap 3' becomes secured to the bag 2' because of its fastener textile strip 87', which is then held against the fastener textile strip 11' carried by the front panel 39'.

In this situation, the bag retains its rectangular block shape, with its top opening 13' then being both deployed and completely covered by the first portion 82' of the flap 3'.

However, the bag 2' can also be folded flat either completely or in part, prior to closing the flap 3'. Under such circumstances, the user causes the tabs 79' and 81' to pivot so as to place them against the corresponding side walls, thereby uncovering the fastener textile strips of the deployers, as shown in FIG. 10.

After this operation, the user exerts pressure on the deployers, moving them towards each other. This pressure enables the deployers 71' and 72' to be folded and thus enables the user also to exert pressure to move the front wall 4' towards the rear wall 14' so as to ensure that the two fastener strips of each deployer come into contact with each other.

At this stage, the textile strips of each deployer 71', 72' hold together so as to be mutually fastened in order to lock each deployer in a folded state, against the return means of the deployer.

Once this has been done, the bag is flattened either completely, or only partially, i.e. it is flattened only in its top portion. The user can then move the flap 3' towards the front of the bag, thereby placing the first portion 82' of the flap against the front panel 39' so that its textile strip 12' fastens to the textile strip 11' carried by the front panel 39', i.e. by the front wall 4'.

Figure 12:
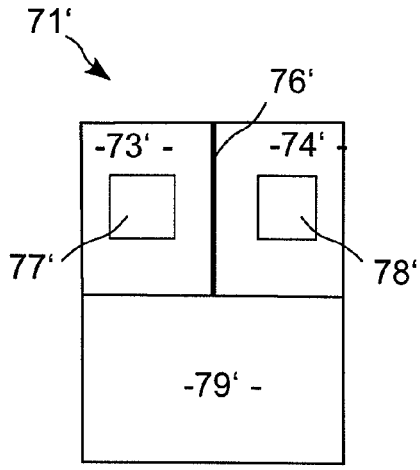
FIG. 12 shows a deployer that is shown on its own and in a flat, deployed state.
Figure 13:
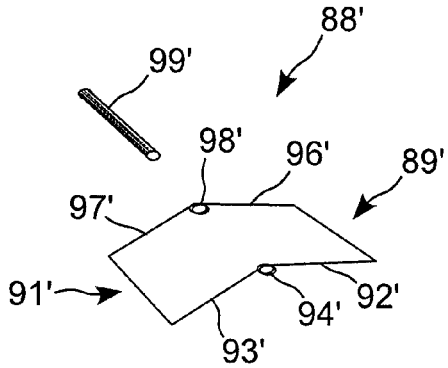
FIG. 13 shows the resilient return means of the deployer on their own.
Figure 14:
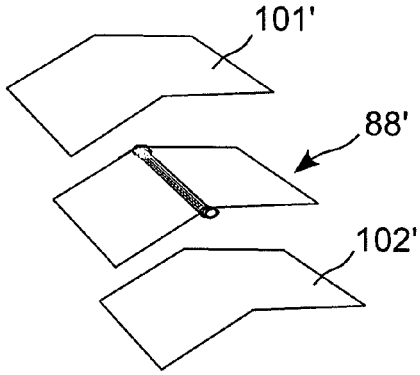
FIG. 14 is an exploded view of the deployer showing its component elements.

The deployer 71' as shown in FIGS. 12 to 14 is identical to the deployer 72'. It includes resilient return means 88' forming a core constituted by two U-shaped portions 89' and 91' that are connected together via their respective ends by helical portions that form springs.

More particularly, the first U-shaped portion 89' has a first limb 92' with its end connected to a first limb 93' of the second U-shaped portion 91' via a helical portion 94' that occupies two turns.

This first U-shaped portion 89' has a second limb 96' with its end connected to a second limb 97' of the second U-shaped portion 91' via another helical-portion 98' likewise extending over two turns.

Overall, the assembly is similar to a clothes-peg spring, of the kind made from a single length of wire or the like. The helical portions 94' and 98' constitute springs that tend continuously to move the webs of the two U-shaped portions apart from each other so that the assembly takes up a generally plane shape of a rectangular frame.

A shaft or tube 99' of length slightly longer than the distance between the two helical portions is engaged therein to stiffen the assembly.

These core-forming return means 88' are interposed between two sheets 101' and 102', with the assembly as a whole being joined together by adhesive, for example.

The fastener textile strips 77' and 78' are stuck onto one of the faces of the assembly, substantially in the middle of each U-shaped portion, and the tab 79' is fastened to the assembly in such a manner as to extend one of the long sides thereof.

The second embodiment of the container of the invention is produced in similar manner to the container of the first embodiment. This is done starting from a bag 2', three pieces, and the deployers 71' and 72'.

The first piece constitutes transverse reinforcement identical to the transverse reinforcement of the first embodiment and fastened to the bag in identical manner.

The second piece is similar to the second piece of the first embodiment, but it is provided with a long flap made up of two portions that extend its central portion, and it does not have internal side reinforcements. It is fastened to the bag in identical manner, via its own central portion, which is bonded to the rear wall by adhesive, above the transverse score line.

The third piece comprises no more than the front panel 39 and does not have a turn-back, and it is stuck to the outside face of the front wall 4'. The deployers 71' and 72' are fitted to the top portions of the outside faces of each of the side walls.

This provides a container that is convenient in use, providing good hygiene (e.g. when used with dog excrement), and/or good security (e.g. when used with pieces of broken glass or the like), and this is achieved for a production cost that is reasonable.

NOMENCLATURE

| | |
|---|---|
| 1; 1' | container |
| 2; 2' | bag |
| 3; 3' | (closure) flap |
| 4; 4' | front wall |
| 6; 6' | opening strap |
| 7; 7' | eyelet |
| 8 | eyelet |
| 9; 9' | free margin |
| 11; 11' | first strip |
| 12; 12' | second strip |
| 13; 13' | opening of the bag |
| 14; 14' | rear wall |
| 16; 16' | first side wall |
| 17; 17' | second side wall |
| 18; 18' | bottom |
| 19; 19' | front bottom edge |
| 21; 21' | first front side edge |
| 22; 22' | second front side edge |
| 23; 23' | first rear side edge |
| 24; 24' | central fold or score line |
| 26; 26' | front panel |
| 27; 27' | rear panel |

-continued

| | |
|---|---|
| 28; 28' | bottom oblique score line |
| 29; 29' | bottom oblique score line |
| 31; 31' | middle peripheral score line |
| 32; 32' | bottom peripheral score line |
| 33 | 1st internal side reinforcement |
| 34 | 2nd internal side reinforcement |
| 35 | hole |
| 36 | deployment strap |
| 37 | hole |
| 38 | hole |
| 39; 39' | front panel |
| 40; 40' | hole |
| 41; 41' | first handle |
| 42; 42' | second handle |
| 43; 43' | central portion |
| 44; 44' | first flap |
| 46; 46' | second flap |
| 47; 47' | opening |
| 48; 48' | opening |
| 49; 49' | score line |
| 50 | adhesive strip |
| 51; 51' | score line |
| 52; 52' | pusher |
| 53; 53' | first piece |
| 54; 54' | second piece |
| 56; 56' | third piece |
| 57; 57' | central rectangle |
| 58; 58' | score line |
| 59; 59' | score line |
| 61; 61' | score line |
| 62; 62' | turn-back |
| 63; 63' | first cut |
| 64; 64' | second cut |
| 66; 66' | fold line |
| 67; 67' | locking means |
| 68; 68' | locking means |
| 69; 69' | parallel cuts |
| 71' | first deployer |
| 72' | second deployer |
| 73' | front flap |
| 74' | rear flap |
| 76' | common edge |
| 77' | first textile strip |
| 78' | second textile strip |
| 79' | tab |
| 81' | tab |
| 82' | first portion |
| 83' | second portion |
| 84' | fold |
| 86' | fold |
| 87' | fastener textile strip |
| 88' | resilient return means |
| 89' | first U-shaped portion |
| 91' | second U-shaped portion |
| 92' | first limb |
| 93' | first limb |
| 94' | helical portion |
| 96' | second limb |
| 97' | second limb |
| 98' | helical portion |
| 99' | shaft or tube |
| 101' | sheet |
| 102' | sheet |

What is claimed is:

1. A container for picking up and transporting waste, in particular dog excrement, the container comprising: a bag and a plurality of flaps, said bag being extended by a first flap suitable for closing and opening the bag, the bag having a front wall and a rear wall, the first flap extending a top edge of the rear wall so as to be capable of occupying either an open position for picking up, in which the flap is folded against an outside face of the rear wall, or else a closed position for transport, in which the first flap is folded against an outside face of the front wall, the bag further comprising a front panel fastened to the outside face of the front wall, said front panel having second and third flaps forming handles that are movable between a position in which they are folded against the front wall, and a utilisation position in which they extend perpendicularly to said front wall.

2. A container according to claim 1, in which the plurality of flaps and the bag are made out of the same material, such as cardstock.

3. A container according to claim 1, having first and second side walls each connecting a side edge of the front wall to a side edge of the rear wall, each side wall comprising a front panel and a rear panel defined by a central fold parallel to the side edges, these panels being capable of being folded against each other in order to move the front wall towards the rear wall in order to fold the bag flat.

4. A container according to claim 3, including at least one internal side reinforcement pivotable about an axis coinciding with a side edge of the front or rear wall so as to be foldable either against an inside face of one of the side walls so as to hold the bag deployed by moving the front and rear walls apart from each other, or else against an inside face of the front or rear wall so as to allow said walls to move towards each other in order to fold the bag flat.

5. A container according to claim 4, including a strap for deploying the bag, the strap having an end that passes through a side wall and that is fastened to a corresponding internal side reinforcement in such a manner as to enable the bag to be deployed by pulling on the strap to fold the side reinforcement against the side wall.

6. A container according to claim 4, including at least one catch or extra thickness projecting from the inside face of the front wall opposite from the front or rear wall having the edge that coincides with the axis about which the internal side reinforcement is capable of being pivoted, so as to lock the internal side reinforcement when it is folded against the side wall.

7. A container according to claim 1, wherein said first flap has a first portion extended by a second portion to close the bag either when it is folded flat, by folding the first portion of the flap onto the front wall, or else when it is deployed, by folding the second portion of the flap onto the front wall.

8. A container according to claim 3, in which each side wall is provided with a deployer including at least one resilient return means continuously tending to urge the two panels forming each side wall into a position in which they are substantially coplanar.

9. A container according to claim 8, in which each deployer comprises two flaps, each fitted to a respective one of the panels of the side wall equipped with the deployer, and in which each flap includes a hook or loop textile strip fastened to its outside face.

10. A container according to claim 9, in which each deployer includes a tab that is movable between a first position in which it covers the hook or loop textile strips of the deployer, and a second position, in which it is folded against an outside face of the side wall to which the deployer is fitted, so as to uncover the hook or loop textile strips.

* * * * *